US006675463B2

(12) United States Patent
Berkcan et al.

(10) Patent No.: US 6,675,463 B2
(45) Date of Patent: Jan. 13, 2004

(54) METHODS FOR FORMING TORODIAL WINDINGS FOR CURRENT SENSORS

(75) Inventors: Ertugrul Berkcan, Niskayuna, NY (US); Daniel Arthur Staver, Scotia, NY (US); Wolfgang Daum, Louisville, KY (US); David Dean Elmore, Brookston, IN (US)

(73) Assignee: General Electric Company, Niskuyana, NY (US)

( * ) Notice: Subject to any disclaimer, the term of this patent is extended or adjusted under 35 U.S.C. 154(b) by 37 days.

(21) Appl. No.: 09/945,768

(22) Filed: Sep. 4, 2001

(65) Prior Publication Data

US 2002/0003464 A1 Jan. 10, 2002

Related U.S. Application Data

(63) Continuation-in-part of application No. 09/642,631, filed on Aug. 18, 2000, now abandoned, which is a continuation-in-part of application No. 09/152,145, filed on Sep. 11, 1998, now abandoned.

(60) Provisional application No. 60/058,589, filed on Sep. 12, 1997.

(51) Int. Cl.[7] ..... H01F 7/123; H01F 7/06

(52) U.S. Cl. ..... 29/602.1; 29/605; 29/606; 336/229; 427/116

(58) Field of Search ..... 29/602.1, 605, 29/606; 336/229, 221, 213; 242/324, 328; 427/116, 104, 372.2

(56) References Cited

U.S. PATENT DOCUMENTS

| | | | | |
|---|---|---|---|---|
| 4,621,231 A | | 11/1986 | Heinrich et al. | |
| 5,353,494 A | * | 10/1994 | Bisbee et al. | 29/605 |
| 5,535,503 A | | 7/1996 | Newman | |
| 5,583,475 A | | 12/1996 | Raholijaona et al. | |

FOREIGN PATENT DOCUMENTS

| | | | | |
|---|---|---|---|---|
| JP | 61179518 | | 8/1986 | |
| JP | 5-21233 | * | 1/1993 | 336/229 X |
| JP | 41122084 | | 8/1999 | |

* cited by examiner

*Primary Examiner*—A. Dexter Tugbang
(74) *Attorney, Agent, or Firm*—Penny A. Clarke; Patrick K. Patnode

(57) ABSTRACT

A method of forming a toroidal winding assembly comprises: forming a longitudinal assembly having a first assembly end and a second assembly end; bending the longitudinal assembly to form a generally toroidal assembly; and bonding the first assembly end to the second assembly end to form the toroidal winding assembly.

24 Claims, 4 Drawing Sheets

METHODS FOR FORMING TORODIAL WINDINGS FOR CURRENT SENSORS

CROSS REFERENCE TO RELATED APPLICATIONS

This Application is a continuation-in-part of U.S. application Ser. No. 09/642,631, filed Aug. 18, 2000, now abandoned which, in turn, is a continuation-in-part of U.S. application Ser. No. 09/152,145, now abandoned filed Sep. 11, 1998, which claims the benefit of U.S. Provisional Application No. 60/058,589, filed Sep. 12, 1997, each of which application is herein incorporated by reference.

BACKGROUND

This invention relates generally to electricity meters and, more particularly, to toroidal winding assemblies for use in current sensing and to methods of making such assemblies.

Current sensors are used in many applications including residential and industrial electric power metering. These sensors typically include a toroidal winding assembly comprising at least one electrically conductive wire wound on a toroidal core. Typically, the core comprises iron or a laminated magnet-quality steel and has a square or circular cross-section. The wire coil that results has the same cross-section and the same generally toroidal shape as the core.

Among the factors contributing to the cost of making this assembly are: the cost of the core material itself; the need to machine the core within specified tolerances; and the difficulty of winding the wire on the pre-formed toroidal core while maintaining a tolerance on the spacing between adjacent winding loops. An opportunity exists, therefore, to lower the cost of such toroidal assemblies by substituting lower cost core materials and by finding an alternative coil winding scheme.

SUMMARY

In accordance with one embodiment of the present invention, a method of forming toroidal winding assemblies comprises: forming a longitudinal assembly having a first assembly end and a second assembly end; bending the longitudinal assembly to form a generally toroidal assembly; and bonding the first assembly end to the second assembly end to form the toroidal winding assembly.

DRAWINGS

These and other features, aspects, and advantages of the present invention will become better understood when the following detailed description is read with reference to the accompanying drawings in which like characters represent like parts throughout the drawings, wherein.

DETAILED DESCRIPTION

Figure 1:
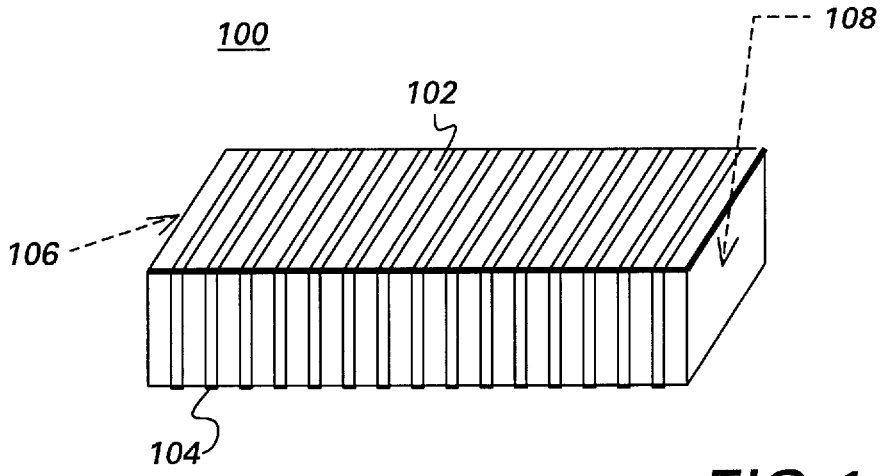
FIG. 1 is a perspective view of a longitudinal assembly in accordance with one embodiment of the present invention.
Figure 2:
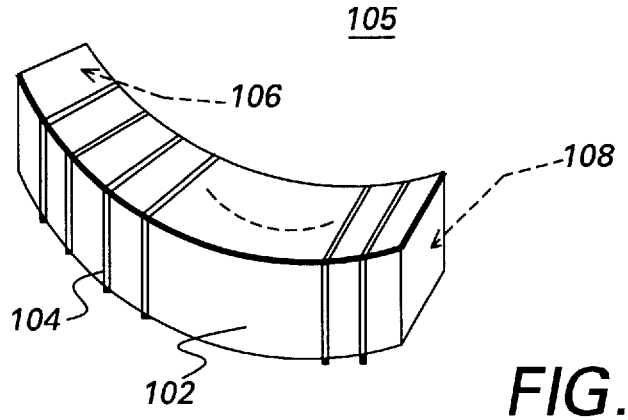
FIG. 2 is a perspective view of a generally toroidal assembly in accordance with the embodiment of FIG. 1.
Figure 3:
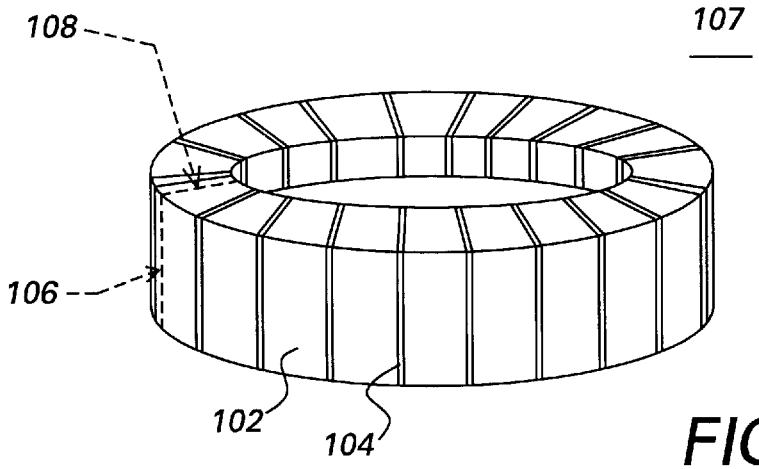
FIG. 3 is a perspective view of a toroidal winding assembly in accordance with the embodiment of FIG. 1.

FIGS. 1–3 illustrate a method of forming a toroidal winding assembly 107 in accordance with one embodiment of the present invention. The method comprises: forming a longitudinal assembly 100 (FIG. 1) having a first assembly end 106 and a second assembly end 108; bending longitudinal assembly 100 to form a generally toroidal assembly 105 (FIG. 2); and bonding first assembly end 106 to second assembly end 108 to form toroidal winding assembly 107 (FIG. 3).

Alternative embodiments of the invention may employ different methods of forming longitudinal assembly 100. As illustrated in FIG. 1, one method of forming longitudinal assembly 100 comprises providing a winding core 102 comprising a core material that is substantially non-ferromagnetic and winding at least one electrical conductor 104 around winding core 102 to form longitudinal assembly 100. As defined herein, "substantially non-ferromagnetic" means having a relative magnetic permeability with respect to air in a range from about 1 to about 1.5. That the winding core be substantially non-ferromagnetic is important when toroidal winding assembly 107 is used as a current sensor. If the core material had a higher relative magnetic permeability, then any residual air gap left after bonding first assembly end 106 to second assembly end 108 would produce an asymmetry in the sensor's magnetic properties that would impair the sensor's ability to ignore ambient magnetic fields and thus reduce the sensor accuracy.

In a more specific embodiment, the core material comprises a core polymer which may be cured. Curing may be achieved by exposing the core polymer to a curing stimulus. Examples of curing stimuli include, but are not limited to, ultraviolet radiation, chemical curing agents, and heat. By way of example, but not limitation, the core polymer may comprise about 100 parts of diglycidyl ether of bisphenol A and about 10 parts of diethylene triamine, mixed at a mixing temperature in a range from about 50 to about 70 degrees Celsius, then cured at a curing temperature of about 25 degrees Celsius. By way of another example, the core polymer may comprise a rubber cured by heat.

In another embodiment of the invention, longitudinal assembly 100 may be coated with a motion constraining material 109 (FIG. 5) prior to bending. If electrical conductor 104 is wound with a uniform coil spacing, motion constraining material 109 serves to preserve the uniform coil spacing during bending. That the coils be uniformly spaced is important because asymmetry in the geometry of toroidal winding assembly 107 reduces sensor accuracy. In more specific embodiments, motion constraining material 109 may comprise a coating polymer which may be cured. Curing may be achieved by exposing the coating polymer to a curing stimulus. Examples of curing stimuli include, but are not limited to, ultraviolet radiation, chemical curing agents, and heat.

By way of more specific example, but not limitation, the coating polymer may comprise a mixture of gelatin and ammonium dichromate baked at a baking temperature in a range from about 50 to about 60 degrees Celsius, or solvent cast polychloroprene baked at a baking temperature in a range from about 25 to about 35 degrees Celsius, or solvent cast styrene-butadiene-styrene co-polymer baked at a baking temperature in a range from about 50 to about 75 degrees Celsius.

Figure 4:
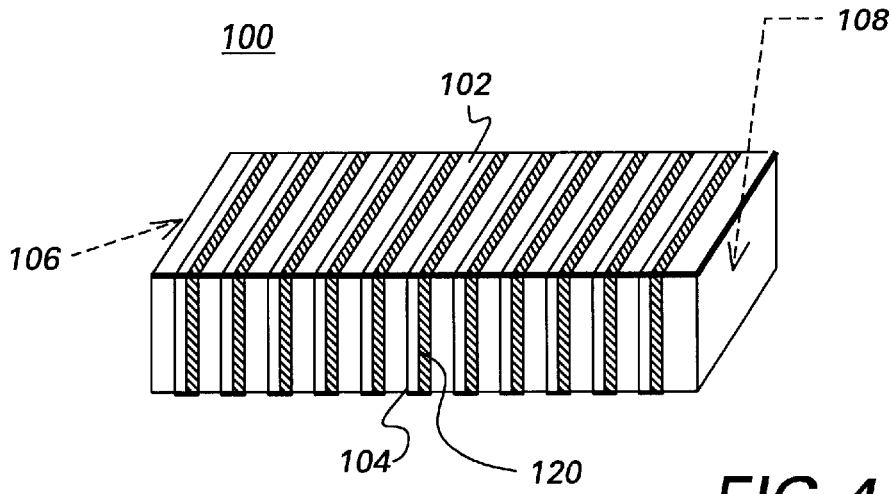
FIG. 4 is a perspective view of the longitudinal assembly in accordance with another embodiment of the present invention.

Regarding another embodiment of the invention, FIG. 4 illustrates a method of forming longitudinal assembly 100 in which a spacing wire 120 is wound around winding core 102 abutting at least one electrical conductor 104. If electrical conductor 104 is wound with a uniform coil spacing, spacing wire 120 serves to preserve the uniform coil spacing during bending. After bending longitudinal assembly 100 to form generally toroidal assembly 105, spacing wire 120 is unwound. Alternative embodiments may use a plurality of spacing wires 120, a plurality of electrical conductors 104 or any combination thereof.

Figure 5:
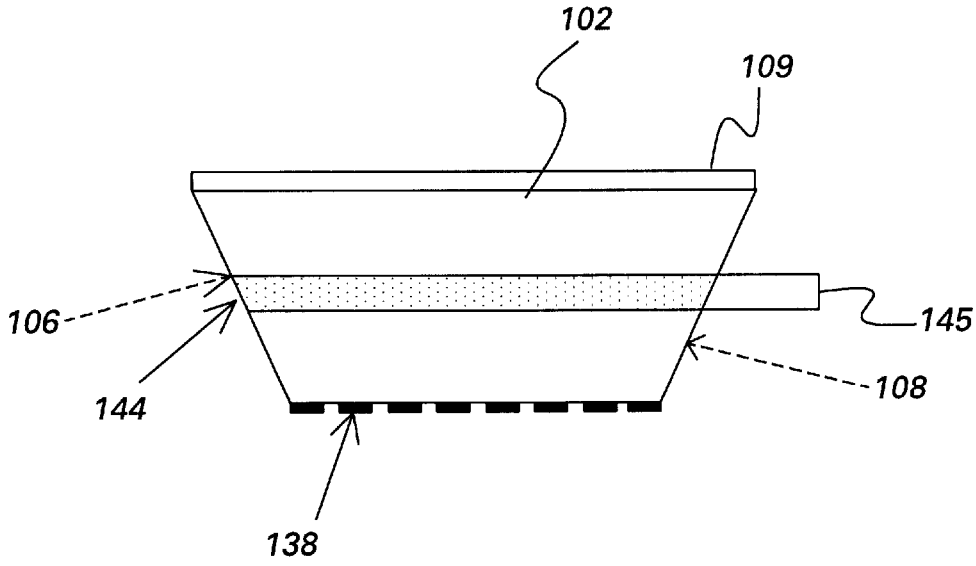
FIG. 5 is a side view of the longitudinal assembly in accordance with another embodiment of the present invention.

In some embodiments of the invention, winding core 102 may comprise a material so compliant as to be awkward to handle. FIG. 5 illustrates a method of forming longitudinal assembly 100 in which, to facilitate handling, a stiffening rod 145 is inserted into a longitudinal hole 144 prior to winding at least one electrical conductor 104 around winding core 102. Stiffening rod 145 may be extracted after winding.

Figure 6:
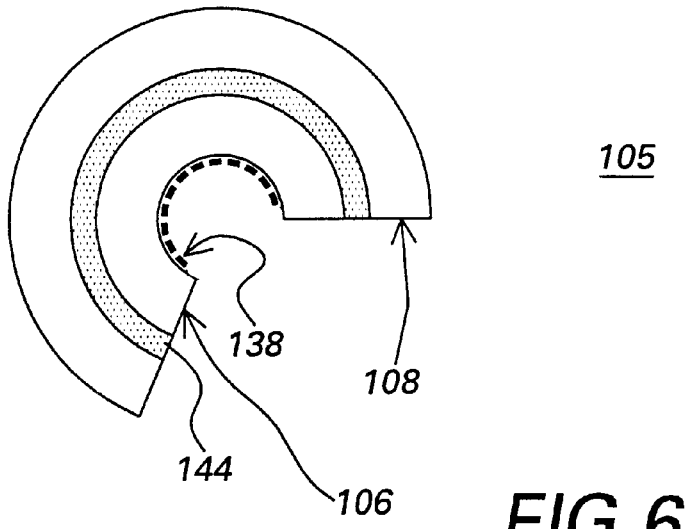
FIG. 6 is a side view of the generally toroidal assembly in accordance with the embodiment of FIG. 5.
Figure 7:
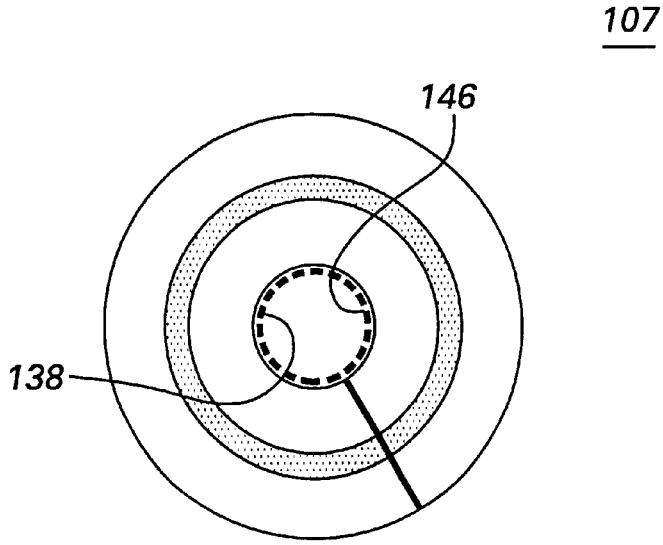
FIG. 7 is a side view of the toroidal winding assembly in accordance with the embodiment of FIG. 5.

Regarding another embodiment of the invention, FIG. 5 illustrates a method of forming longitudinal assembly 100 which comprises applying to winding core 102 a winding support layer 138 having a plurality of winding grooves 146 and winding at least one conductor 104 (not shown) in winding grooves 146. Winding support layer 138 aids in providing uniform coil spacing. In accordance with the embodiment of FIG. 5, FIGS. 6 and 7 illustrate, respectively, bending longitudinal core 100 to form a generally toroidal assembly 105, and bonding first assembly end 106 to second assembly end 108 to form toroidal winding assembly 107.

Figure 8:
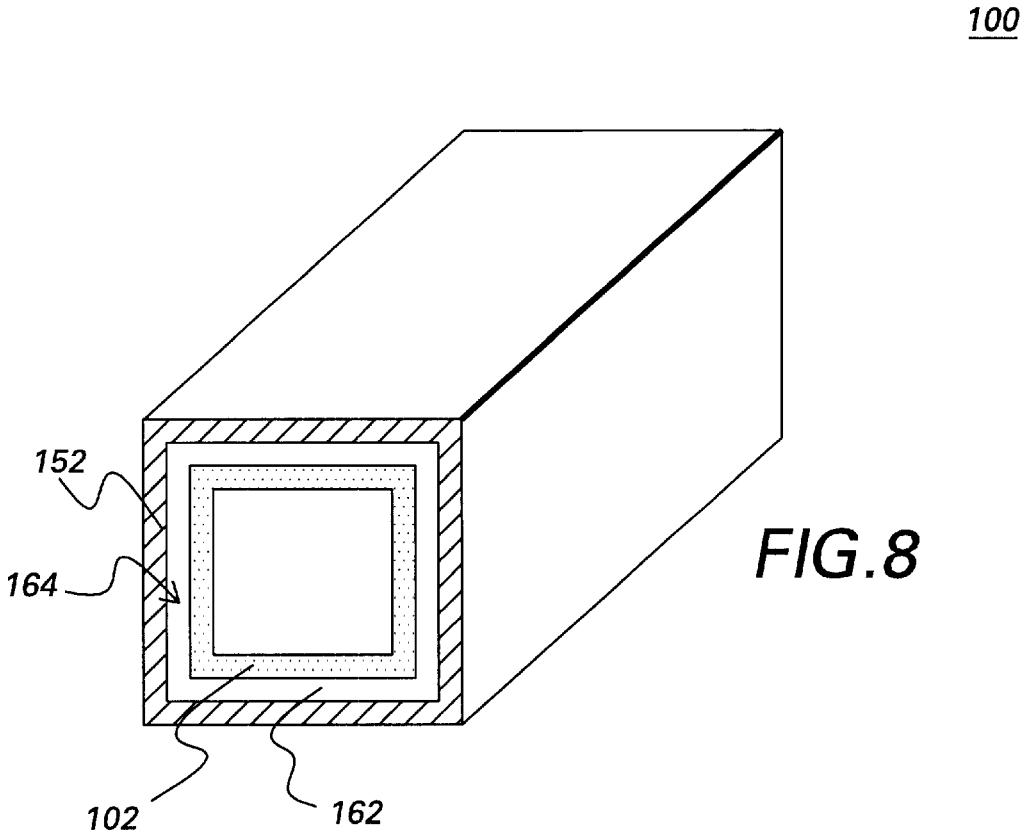
FIG. 8 is a perspective view of the longitudinal assembly in accordance with another embodiment of the present invention.
Figure 9:
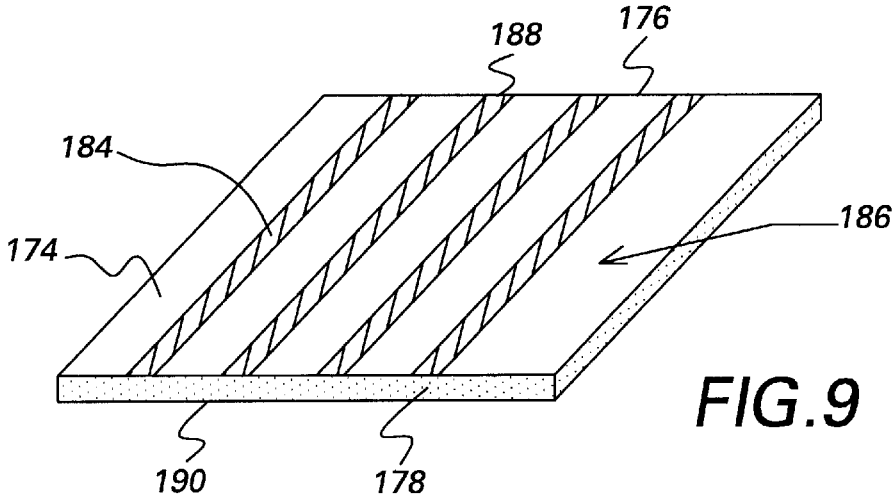
FIG. 9 is a perspective view of a dielectric sheet substrate in accordance with another embodiment of the present invention.

In accordance with another embodiment of the invention, FIG. 8 illustrates an alternative method of forming longitudinal assembly 100 by inserting winding core 102 into an outer shell 152 after winding at least one conductor 104 around winding core 102. Outer shell 152 is an alternative means of restraining any motion of electrical conductor 104 (FIG. 1) during bending.

In a more specific embodiment of the invention in accordance with FIG. 8, outer shell 152 comprises an outer shell material that contracts upon exposure to a contraction stimulus. For example, materials used for shrinkable tubing, such as polyvinyl chloride (PVC), polyolefin, neoprene, or polyvinylidene fluoride (PVDF), may be made to contract upon exposure to heat. After inserting winding core 102 into outer shell 152, outer shell 152 is exposed to the contraction stimulus to form longitudinal assembly 100. Contracted outer shell 152 in conjunction with winding core 102 serves to restrain any motion of electrical conductor 104 (not shown in FIG. 8) during bending.

In another embodiment in accordance with the invention of FIG. 8, motion of electrical conductor 104 (not shown) may be constrained by filling an annular gap 162 between winding core 102 and outer shell 152 with a filler material 164. In more specific embodiments, filler material 164 may comprise a filler polymer which may be cured. Curing may be achieved by exposing the filler polymer to a curing stimulus. Examples of curing stimuli include, but are not limited to, ultraviolet radiation, chemical curing agents, and heat. By way of example, but not limitation, the filler polymer may comprise solvent cast polychloroprene.

FIG. 10 illustrates another method of forming a longitudinal assembly 100 in accordance with the present invention. A first pattern of electrically conducting strips 184 is produced on a first face 186 of a dielectric sheet substrate 174. Each of the electrically conducting strips 184 has a first strip end 188 and a second strip end 190 coinciding with a first sheet edge 176 and a second sheet edge 178, respectively. First sheet edge 176 is attached to second sheet edge 178 such that first strip end 188 of each electrically conducting strip 184 forms an electrically conductive junction with second strip end 190 of an adjacent one of electrically conducting strips 184. Joining each electrically conductive junction, for example, by soldering, forms longitudinal assembly 100. In another embodiment of the invention, a second pattern of electrically conducting strips 184 is produced on a second face (not shown) of dielectric sheet substrate 174, the second pattern forming a conducting coil inside a conducting coil formed by the first pattern.

While only certain features of the invention have been illustrated and described herein, many modifications and changes will occur to those skilled in the art. It is, therefore, to be understood that the appended claims are intended to cover all such modifications and changes as fall within the true spirit of the invention.

What is claimed is:

1. A method of forming a toroidal winding assembly, said method comprising:

forming a longitudinal assembly having a first assembly end and a second assembly end, wherein forming said longitudinal assembly comprises:

providing a winding core, said winding core comprising a substantially non-ferromagnetic core material, winding at least one electrical conductor around said winding core, and winding at least one spacing wire around said winding core abutting said at least one electrical conductor, wherein said method further comprises:

bending said longitudinal assembly to form a generally toroidal assembly;

bonding said first assembly end to said second assembly end to form said toroidal winding assembly; and unwinding said at least one spacing wire after bending said longitudinal assembly.

2. The method of claim 1 wherein said core material comprises a core polymer.

3. The method of claim 2 further comprising curing said core polymer.

4. The method of claim 3 wherein curing said core polymer exposing said core polymer to a curing stimulus selected from the group consisting of ultraviolet radiation, chemical curing agents, and heat.

5. The method of claim 2 wherein providing said winding core comprises:

providing a rubber winding core; and curing said rubber winding core with heat.

6. The method of claim 2 wherein forming said longitudinal assembly further comprises:

inserting a stiffening rod into a longitudinal hole of said winding core prior to winding said at least one electrical conductor around said winding core; and extracting said stiffening rod after winding said at least one electrical conductor around said winding core.

7. The method of claim 2 further comprising coating said longitudinal assembly with a motion constraining material.

8. The method of claim 7 wherein said motion constraining comprises a coating polymer.

9. The method of claim 8 further comprising curing said coating polymer.

10. The method of claim 9 wherein curing said coating polymer comprises exposing said coating polymer to a curing stimulus selected from the group consisting of ultraviolet radiation, chemical curing agents, and heat.

11. The method of claim 7 wherein coating said longitudinal assembly with a motion constraining material comprises:

mixing a mixture of gelatin and ammonium dichromate;

coating said longitudinal assembly with said mixture; and baking said coated longitudinal assembly at a baking temperature in a range from about 50 to about 60 degrees Celsius.

12. The method of claim 7 wherein coating said longitudinal assembly with a motion constraining material comprises:

solvent casting polychloroprene so as to coat said longitudinal assembly; and baking said coated longitudinal assembly at a baking temperature in a range from about 25 to about 35 degrees Celsius.

13. The method of claim 7 wherein coating said longitudinal assembly with a motion constraining material comprises:

solvent casting styrene-butadiene-styrene co-polymer so as to coat said longitudinal assembly; and baking said coated longitudinal assembly at a baking temperature in a range from about 50 to about 75 degrees Celsius.

14. The method of claim 1 wherein providing said winding core comprises:

mixing a mixture of about 100 parts of diglycidyl ether of bisphenol A and about 10 parts of diethylene triamine at a mixing temperature in a range from about 50 to about 70 degrees Celsius; and curing said mixture at a curing temperature of about 25 degrees Celsius.

15. The method of claim 1 wherein:

forming said longitudinal assembly further comprises applying to said winding core a winding support layer having a plurality of winding grooves; and winding at least one electrical conductor around said winding core further comprises winding said at least one conductor in said winding grooves.

16. The method of claim 1 wherein forming said longitudinal assembly further comprises inserting said winding core into an outer shell after winding said at least one conductor around said winding core.

17. The method of claim 16 wherein:

outer shell comprises an outer shell material adapted to contract upon exposure to a contraction stimulus; and forming said longitudinal assembly further comprises exposing said outer shell to said contraction stimulus after inserting said winding core into said outer shell.

18. The method of claim 16 wherein forming said longitudinal assembly further comprises filling an annular gap between said winding core and said outer shell with a filler material.

19. The method of claim 18 wherein said filler material comprises a filler polymer.

20. The method of claim 19 wherein said filler polymer comprises polychloroprene.

21. The method of claim 19 further comprising curing said filler polymer.

22. The method of claim 21 wherein curing said filler polymer comprises exposing said filler polymer to a curing stimulus selected from the group consisting of ultraviolet radiation, chemical curing agents, and heat.

23. The method of claim 18 further comprising removing said outer shell after bending said longitudinal assembly.

24. A method of forming a toroidal winding assembly comprising:

providing a winding core comprising a substantially non-ferromagnetic core polymer;

winding at least one electrical conductor around said winding core;

winding at least one spacing wire around said winding core abutting said at least one electrical conductor to form a longitudinal assembly having a first assembly end and a second assembly end;

bending said longitudinal assembly to form a generally toroidal assembly;

unwinding said at least one spacing wire after bending said longitudinal assembly; and bonding said first assembly end to said second assembly end to form said toroidal winding assembly.

* * * * *